United States Patent [19]

Tamai et al.

[11] 4,036,001

[45] July 19, 1977

[54] METHOD AND APPARATUS FOR DOFFING AND DONNING BOBBINS IN SPINNING MACHINE

[75] Inventors: Hideo Tamai, Kariya; Takayuki Morita, Ohbu; Masanao Kobayakawa, Anjyo; Ikuo Komura, Toyota, all of Japan

[73] Assignee: Kabushiki Kaisha Toyoda Jidoshokki Seisakusho, Kariya, Japan

[21] Appl. No.: 670,376

[22] Filed: Mar. 25, 1976

[30] Foreign Application Priority Data

Mar. 31, 1975 Japan ..... 50-37881
Mar. 31, 1975 Japan ..... 50-42094

[51] Int. Cl.[2] ..... D01H 9/04; D01H 9/18
[52] U.S. Cl. ..... 57/52; 57/156
[58] Field of Search ..... 57/52–54, 57/34 R, 156

[56] References Cited

U.S. PATENT DOCUMENTS

| | | | |
|---|---|---|---|
| 3,550,368 | 12/1970 | Marenco | 57/52 |
| 3,609,952 | 10/1971 | Chiari et al. | 57/52 |
| 3,633,959 | 1/1972 | McCullough et al. | 57/52 X |
| 3,786,621 | 1/1974 | Pray et al. | 57/52 |
| 3,808,788 | 5/1974 | Viglione | 57/52 |
| 3,813,870 | 6/1974 | Viglione | 57/52 X |

*Primary Examiner*—Richard C. Queisser
*Assistant Examiner*—Charles Gorenstein
*Attorney, Agent, or Firm*—Wenderoth, Lind & Ponack

[57] ABSTRACT

A bobbin doffing and donning method in a spinning machine including a conveyor for conveying the empty and full bobbins along the machine, and a succession of bobbin holders for holding and transferring the bobbins between the spindles on the machine and the conveyor. The empty bobbins are removed from the conveyor by grasping the upper end of an empty bobbin by a holder and moving the holder upwardly. The holder is then moved to position the empty bobbin above a corresponding full bobbin on a spindle with the empty bobbin in axial alignment with the full bobbin. The empty bobbin is released from the holder and the lower end abuts against the upper end of the full bobbin. The holder is moved down along the empty bobbin until it reaches the junction between the empty and full bobbins and then grasps both the empty and full bobbins simultaneously. The holder holding the empty and full bobbins is then moved up and then away from the spindle and then downwardly to adjacent the conveyor and only the full bobbin is placed on the conveyor. The holder is moved upwardly along the empty bobbin and grasps the upper end, and the empty bobbin is then moved above the spindle and placed on the spindle.

8 Claims, 20 Drawing Figures

METHOD AND APPARATUS FOR DOFFING AND DONNING BOBBINS IN SPINNING MACHINE

BACKGROUND OF THE INVENTION

This invention relates generally to spinning machines, such as a spinning frame, a twisting frame and the like, and, in particular, to an improved doffing and donning method and apparatus applicable to the spinning machine of the type which is adapted to apply empty bobbins, carried on a conveying means, to the spindle thereof, from which full bobbins have been doffed.

Conventional stationary doffing apparatuses, of the type where all the full bobbins on each side of the spinning machine or a group of full bobbins are doffed simultaneously, can be broadly classified into three groups. The first group of doffing apparatuses, which is hereinafter referred to as "a duel conveyer type", comprises two conveyers, one for the full end and one for the empty bobbins, respectively, the full bobbins doffed from the machine spindles being placed on the full bobbin conveyer and the empty bobbins on the conveyer therefor being fitted onto the spindles from which the full bobbins have been doffed. The second group of doffing apparatuses, which is hereinafter referred to as "a single conveyer type", comprises a single conveyer having a plurality of bobbin supporting pegs arranged thereon at intervals half of the spacing between the adjacent spindles. The full bobbins doffed from the spindles are disposed on the alternate pegs and thereafter the conveyer is moved a length corresponding to the interval between the adjacent pegs so that the empty bobbins disposed on the remaining pegs between the full bobbins can be transferred to their donning position. Finally, the doffing apparatuses falling in the third group, which is hereinafter referred to as "a temporary refuge type", comprise a single conveyer and a refuge support, either the full bobbins or the empty bobbins being temporarily placed on the refuge support on the way thereof from the spindles to the conveyer or vice versa.

However, these groups of conventional doffing apparatuses have disadvantages. That is, the duel conveyer type apparatus requires a larger installation space due to the employment of two conveyers. The single conveyer type apparatus can not accommodate large packages, because the interval between the adjacent pegs is half of the spacing between the adjacent spindles, and the doffing method as carried out by this apparatus includes an additional step of moving the conveyer a distance corresponding to the interval between the pegs. Thus, a long time is necessary for the bobbins to be doffed and donned. The temporary refuge type apparatus can produce large packages. However, this also requires an additional step of temporarily storing the full or empty bobbins on the refuge support, resulting in the same disadvantage as the single conveyer type apparatus. In addition, the temporary refuge type apparatus is complex in construction.

With respect to bobbin holders for holding the bobbins to enable the bobbins to travel therewith, it is required that in a case of the full bobbin the holder holds it positively without causing any damage to the yarn layer thereon and the apparatus must mount the bobbin on and demount the bobbin, from the spindle, the refuge support and the conveyer without fail. Thus, it is understood that the bobbin holder preferably comprises a positive holding member, or members which is forcedly operated for the positive holding and release of the bobbin.

It is accordingly a principal object of this invention to provide a method and apparatus for doffing and donning bobbins in a spinning machine, which allows production of large packages with a reduced number of operating steps and without necessitating a complex construction.

It is another object of this invention to provide a method and apparatus for doffing and donning bobbins in a spinning machine wherein the doffing and donning is carried out by using the same pitch of bobbin holders and conveyor pegs as the pitch of the spindles of the spinning machine.

According to the invention, the method and apparatus for doffing and donning bobbins employ a plurality of improved bobbin holders, each of which is designed to positively hold both a full bobbin and an empty bobbin at one time so that the doffing and donning can be effected with relatively low frequency of movement of the bobbin holder, thus reducing the complexities and reducing the time for the doffing and donning.

According to the doffing and donning method of the invention, in a spinning machine of the type wherein at least one row of spindles is arranged along the side thereof and empty bobbins are applied to the spindles to take up yarns thereon to thereby provide full bobbins, the removal of the full bobbins from the associated spindles is carried out by moving the corresponding bobbin holders, which at this stage hold the empty bobbins too. The holder with the full and empty bobbins is then moved to place only the full bobbin in a predetermined position on a conveyer extending along the spinning machine and thereafter the holder applies the empty bobbin to the corresponding spindle.

In one embodiment, in order to allow the bobbin holder to positively hold the empty and full bobbins simultaneously, the bobbin holder comprises a fluid operated holding member with upper and lower holding portions, and a generally hollow body having an access opening provided therein. The holding member is fluid operated and moved between a retracted and a projected position to adjust the effective diameter of the acess opening. When the holding member is in the projected position, the holder can hold simultaneously both the full bobbin and the empty bobbin at the upper and lower portions of the holding member, respectively, and when the holding member is in the retracted position, the effective diameter of the access opening is made larger than the maximum diameter of the empty bobbin so that the empty bobbin held by the holding member at its lower holding portion is allowed to move down free of the holder.

BRIEF DESCRIPTION OF THE DRAWINGS

The invention will become more readily apparent from the following detailed description taken in conjunction with accompanying drawings in which.

DESCRIPTION OF THE EMBODIMENT

Figure 1:
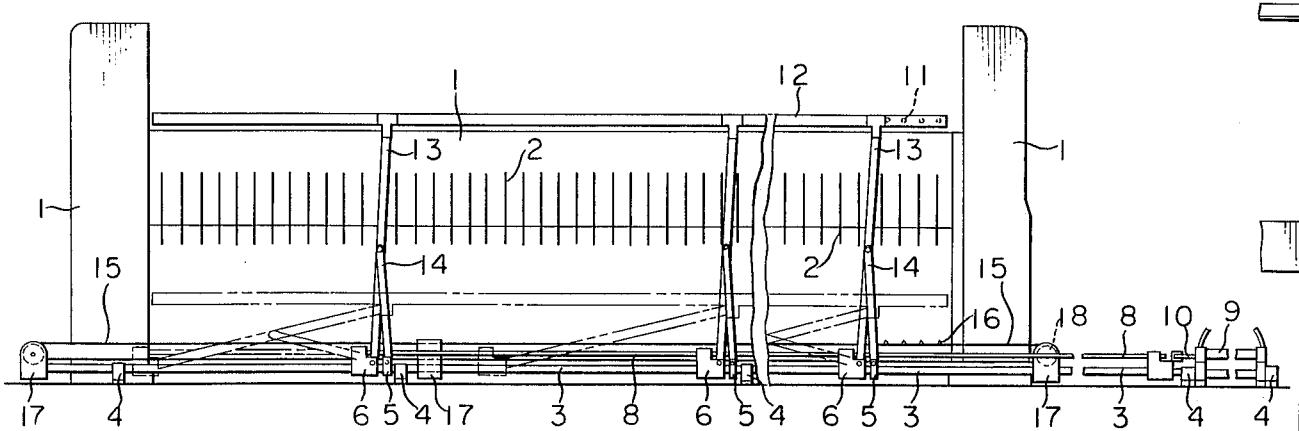
FIG. 1 is an elevational view substantially diagrammatically illustrating, only by way of example, one side of a spinning frame to which a doffing and donning method and apparatus of the present invention are applicable.

Referring now to the drawings and, in particular, to FIG. 1, there is shown, by way of example, a spinning frame to which the present invention is applicable. Although the following description will be made in conjunction with the spinning frame, the invention is clearly not limited thereto. The spinning frame comprises a succession of individual spindles 2 carried for rotation by a frame structure 1 in a conventional manner. In order to automatically doff full bobbins or wound packages 32 (see FIG. 2) on the spindles 2 and to replace them with empty bobbins 31 (see FIG. 2), a doffing and donning apparatus is provided along the side of the spinning frame. In the embodiment, shown the doffing and donning apparatus is adapted to doff simultaneously all the full bobbins from the spindles arranged in succession on one side of the spinning frame and to apply the empty bobbins simultaneously to all these spindles. However, it is understood that a doffing and donning apparatus may be designed to cooperate with grouped spindles and in this case a plurality of doffing and donning apparatuses corresponding to the number of spindle groups may be arranged along the side of the spinning machine.

Figure 2:
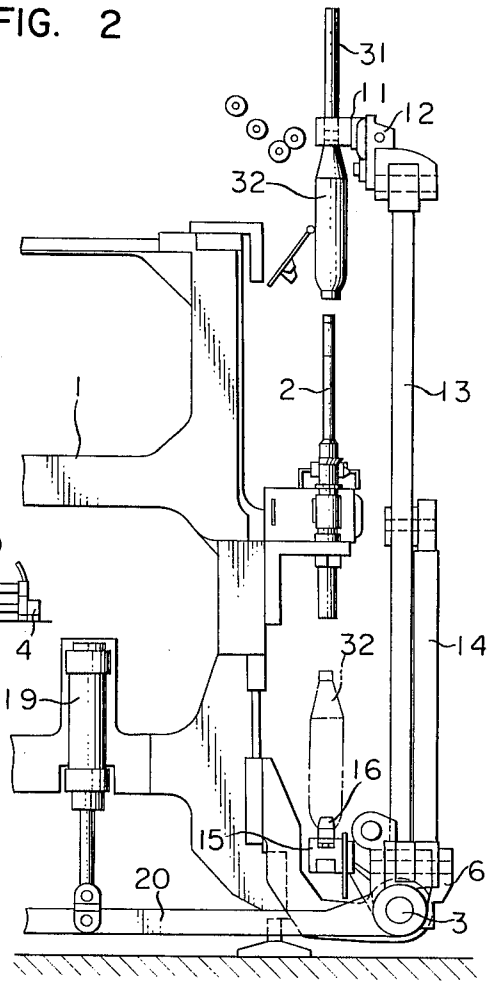
FIG. 2 is a side elevational view fragmentarily showing the right half of the spinning frame of FIG. 1, on an enlarged scale, with the head stock thereof being removed.

The doffing and donning apparatus comprises a turnable shaft 3 disposed adjacent to the lower portion of the frame structure 1 so as to extend along the side of the spinning frame. The shaft 3 is supported for rotation in conventional bearings 4 on a floor. The turnable shaft 3 is provided with a suitable number of stationary brackets 5 fixed thereto and a suitable number of movable brackets 6 loosely mounted on the shaft 3. Each of the stationary brackets 5 is associated with a suitable mechanism for controlling the turning of the shaft 3, which as shown in FIG. 2 normally comprises a fluid operated cylinder and piston assembly 19 and a pivotable lever 20 connected to the piston rod of the assembly 19. By operating the cylinder and piston assembly 19, a predetermined amount of rotation is given through the lever 20 and the bracket 5 to the turnable shaft 3. With respect to the movable bracket 6, a reciprocating transverse rod 8 is connected thereto so as to extend parallel to the shaft 3. The rod 8 is connected to one end of a piston rod 10 operated by a fluid cylinder 9, which is arranged near the end of the spinning frame. Therefore, when the cylinder 9 is operated, the rod 8 moves in the lefthand or righthand direction with the brackets 6. Thus, it is understood that the shaft 3 acts as a guide for the brackets 6 and accordingly the rod 8.

Further, it is understood that the turning motion of the stationary brackets 5 and the reciprocating motion of the movable bracket 6 have to be transmitted to a succession of bobbin holders 11 of the doffing and donning apparatus so as to allow the holders 11 to make predetermined movements relative to the related spindles 2. For this purpose, the bobbin holders 11 are mounted on a doffing bar 12, extending along substantially the entire length of the spinning frame 1, at the same intervals as the spindles 2 and the doffing bar 12 is pivotally connected to upper ends of longitudinal levers 13, the other ends of which are pivotally connected to the movable brackets 6. To substantially the mid portion of each longitudinal lever 13, one end of a short lever 14 is pivotally connected and the other end of the lever 14 is pivotally connected to a corresponding stationary bracket 5. Thus, the length of each short lever 14 is about a half of that of a lever 13.

In FIG. 1, the highest position of the abovedescribed arrangement is shown by a solid lines and the lowest position by dotted and dashed lines. With the abovedescribed arrangement, when the piston rod 10 is retracted or extended by the operation of the cylinder 9, the rod 8 is moved rightward or leftward together with the brackets 6, whereby the doffing bar 12 connected through the levers 13 with the movable brackets 6 is moved upward or downward. When the piston and cylinder assembly 19 (FIG. 2) is operated to turn the lever 20 in the clockwise or counterclockwise direction in FIG. 2, the brackets 5, the levers 3 and 4 and the doffing bar 12 are also turned in the same direction. Therefore, the bobbin holder 11 is also turned within a predetermined angle. FIG. 2 shows the holder 11 in a position directly above the associated spindle.

Means for conveying the bobbins, such as a conveyer 15, is arranged along the side of the spinning frame with a succession of bobbin supporting pegs or projections 16 thereon and in a position allowing the holders 11 to remove the empty bobbins from the associated pegs 16 and to apply the full bobbins to the pegs from which the empty bobbins have been removed. The conveyer 15 is adapted to travel in the lengthwise direction of the spinning frame and the adjacent pegs 16 provided on the conveyer are spaced apart a distance corresponding to the pitch of the spindles 2. It is preferable that the pegs 16 on the conveyer 15 are maintained upright during the time the application of the full bobbins thereto and the removal of the empty bobbins therefrom are not effected and when the conveyer 15 travels in the predetermined direction. During the doffing operation by the holders 11 to the corresponding pegs 16, the pegs 16 are preferably inclined at the same angle as the inclination of the bobbin holders 11 in order to simplify the doffing and donning procedure. For this purpose, in the embodiment illustrated, the conveyer 15 is supported by a suitable number of brackets 17 fixedly mounted on the turnable shaft 3. The travel of the conveyer 15 is effected by rotating a driving pulley 18 mounted for rotation on the righthandmost bracket 17 and connected through a universal joint (not shown) with a not shown power source. Therefore, when the lever 20 is operated by the piston and cylinder assembly 19, all of the brackets 5 and 6, the bobbin holders 11, the conveyer 15, the brackets 17 and the others are inclined in the desired direction.

The above described mechanism for giving the required movements to the bobbin holders 11 is shown only by way of example and other mechanisms can be used for the same purpose. In addition, it is not always necessary that the conveyer 15 be inclined along with the bobbin holders 11.

Figure 3:
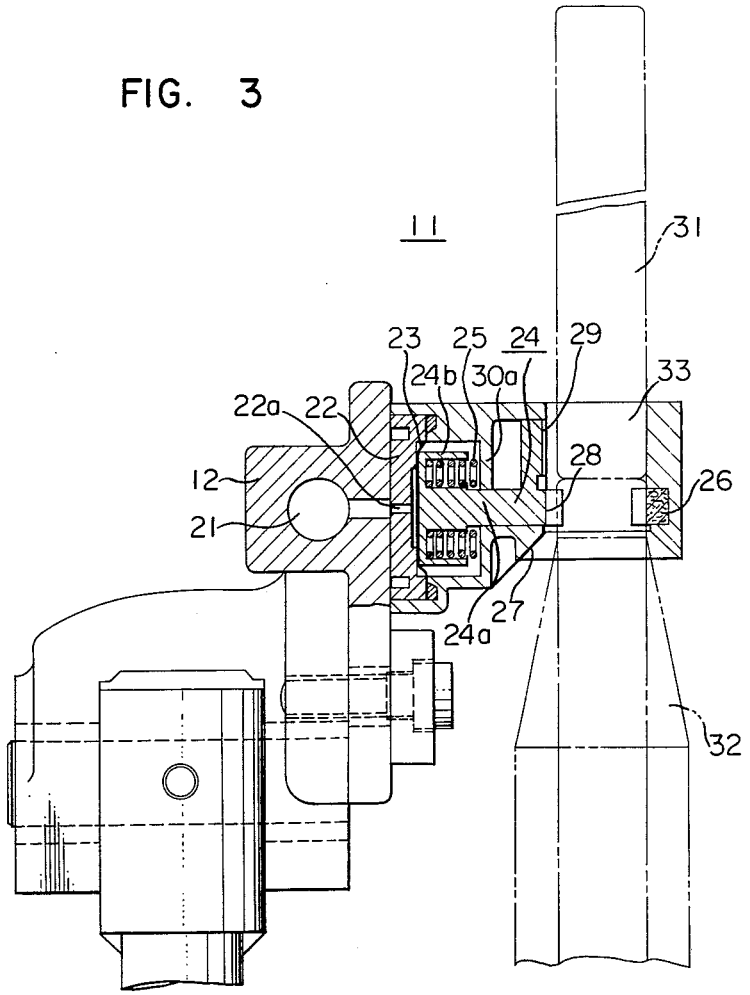
FIG. 3 is a fragmental view of a bobbin holder according to the invention, partly in section and partly in elevation.

FIG. 3 shows bobbin holder means 11 according to the invention, which is applicable to the doffing and donning apparatus shown in FIGS. 1 and 2 and comprises a hollow body 30 having a space or an access opening 33 for receiving therein either the empty bobbin 31 or the full bobbin 32 or both of them, a fluid operated holding member or piston 24 housed in the body 30 so as to be moved radially outwardly and inwardly relative to the access opening 33 to restrict the diameter of the opening 33, and means for normally biasing the holding member 24 in a radially outwardly retracted position. In the embodiment shown, the biasing means comprises springs 25 provided around a stem portion 24*a* of the holding member 24, which extends through a wall 30*a* of the body, acting as a spring seat, into the interior of the hollow body 30 and is provided at the lefthand end thereof in FIG. 3 with a cup-like portion 24*b*. The spring 25 are partly housed in the cup 24*b* and disposed between the bottom of the cup 24*b* and the wall 33*a*. In order to allow the simultaneous holding of the empty and full bobbins 31 and 32, the holding member 24 is provided with a lower and an upper holding portion 28 and 29 each having an arcuate surface which contacts the bobbin. Since the lower holding portion 28 has to hold the relatively heavy full bobbin 32, an arcuate friction member 26 providing a relatively large frictional resistance is preferably provided in the access opening 33 in the opposite position to the lower holding portion 28 to assure the tight holding of the full bobbin 32. The friction member 26 may be made of felt, leather, rubber or the like.

The bobbin holder 11 is fixedly secured by a not shown conventional means to the doffing bar 12 to be moved thereby in accordance with a doffing and donning procedure as will be hereinafter described in detail. A fluid passageway 21 is provided in the doffing bar 12 so as to be in fluid communication with a not shown source of fluid pressure disposed separately from the spinning frame. The holder 11 comprises a plate member 22 disposed between the doffing bar 12 and the bottom of the cup 24*b* of the holding member 24. The plate member 22 is attached to the doffing bar 12 in fluid and air tight relationship therewith and has a fluid passageway 22a in fluid communication with one of the branches of the passageway 21. Between the plate member 26 and the cup-like portion 24*b* of the holding member 24, there is a diaphragm 23 disposed in fluid and air tight relation with respect to the inner wall of the body 30. The fluid passageway 22*a* extends through the overall thickness of the plate member 22 to allow the fluid to flow into the space between the plate member 22 and the diaphram 23. The access opening 33 has a conical surface 27 extending from the circumferential lower edge of the access opening 33 to facilitate the insertion of the bobbin into the access opening 33.

In the embodiment shown in FIG. 3, the empty and full bobbins are adapted to be held simultaneously by the single holding member 24 having the upper and lower holding portions. However, it is easy for those skilled in the art to modify the holder to include two holding members, which can hold the empty and full bobbins, respectively. In addition, the holding member may be moved between the retracted and projected positions by using known mechanical and/or electrical means instead of the fluid pressure.

In operation, when the pressurized fluid is supplied to the fluid passageway 21, the fluid flows through the through passageway 22*a* into the space between the plate member 22 and the diaphragm 23 to expand the diaphragm 23 against the spring 25, whereby the holding member 24 is brought into the projected position, in which the lower and upper holding portions 28 and 29 of the holding member 24 tightly hold the full bobbin 32 and the empty bobbin 31 respectively. The pressure of the fluid may be adjusted to accommodate itself to conditions of a bobbin to be held. When the pressure is released, the holding member 24 is moved back into the retracted position by the springs 25. At this time, the effective diameter of the access opening 33 is made larger than that of the maximum diameter portion of the empty bobbin 31.

The doffing and donning method can be simplified, as will be described hereinafter, by employing the combination of the bobbin holders 11 capable of holding the empty bobbin 31 and the full bobbin 32 simultaneously and corresponding in pitch to the spindles 2 arranged along the side of the spinning frame, and the single conveyer having the pegs 16 also corresponding in pitch to the spindles arranged along the side of the spinning frame. That is, the doffing and donning method according to the invention is characterized by the steps of removing the full bobbins from the associated spindles by the holders, which have held the empty bobbins, and moving the holders with the empty and full bobbins down to apply only the full bobbins to the corresponding pegs on the conveyer.

In connection with FIGS. 4A to 4Q, a succession of doffing and donning steps according to the invention will be described hereinafter.

Figure 4A:
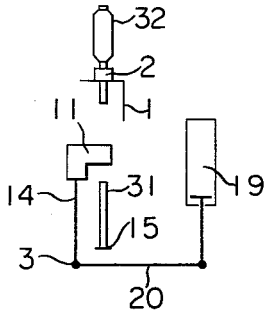
FIGS. 4A to 4Q are diagrammatic views for explaining successive doffing and donning steps according to the invention.
Figure 4B:
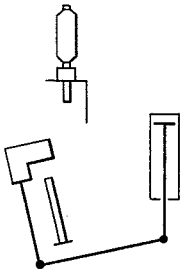
Figure 4C:
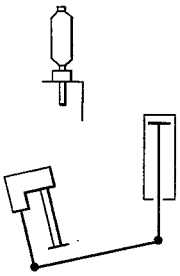
Figure 4D:
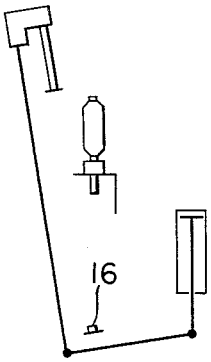
Figure 4E:
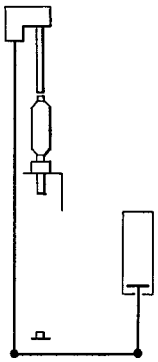
Figure 4F:
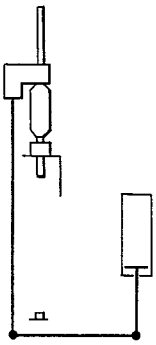
Figure 4G:
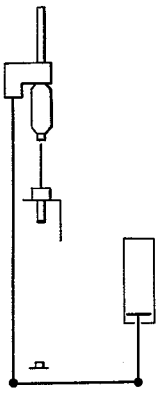
Figure 4H:
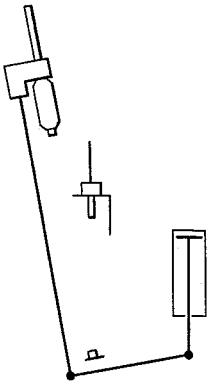
Figure 4I:
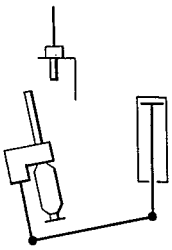
Figure 4J:
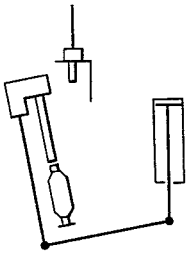
Figure 4K:
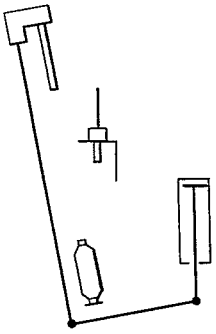
Figure 4L:
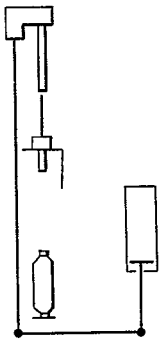
Figure 4M:
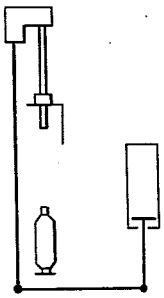
Figure 4N:
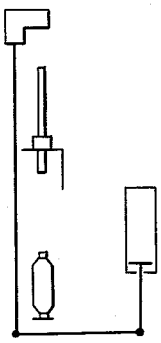
Figure 40:
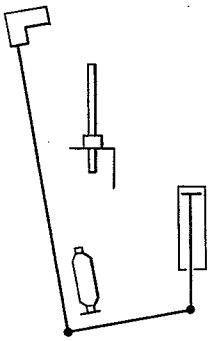
Figure 4P:
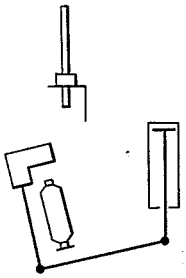
Figure 4Q:
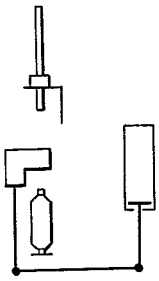

FIG. 4A shows positional relationships of the related members just before the doffing operation commences, wherein the empty bobbins 31 have been provided on the pegs of the conveyer 15 and the bobbin holders 11 are in the upright rest position, in which each holder is positioned directly above the empty bobbin in alignment therewith and beneath the spindle rail supporting the spindles 2. When doffing, firstly, the bobbin holders 11 as well as the conveyer 15 are brought into the inclined position, wherein each holder is inclined relative to the spindle 2, but is in alignment with the empty bobbin 31 (see FIG. 4B). The holders 11 move down while being maintained in the inclined position to grasp the heads of the associated empty bobbins 31 with the lower holding portions 28 or both the lower and upper portions 28 and 29 of the holding members thereof (see FIG. 4C). Thereafter, as shown in FIG. 4D, the holders 11 are raised together with the empty bobbins 31 until the lower ends of the empty bobbins held by the holders become higher than the tops of the full bobbins fitted onto the spindles. Then, the holders 11 are turned from the inclined position to the upright position as shown in FIG. 4E, in which each empty body 31 is directly above the corresponding full bobbin 32 fitted onto the spindle 2. At the end of the step shown in FIG. 4E, the pressure imposed on the holding members 24 of the holders 11 is released and therefore each empty bobbin 31 becomes free of the holding member 24 and falls straight while being guided by the access opening 33 in the holder 11, and its lower end abuts against the upper end of the full bobbin 32. Substantially simultaneously with the falling of the empty bobbin 31, the bobbin holder 11 is moved down as shown in FIG. 4F into a position, in which it can simultaneously hold the lower end portion of the empty bobbin 31 with its upper holding portion 29 and the upper end portion of the full bobbin 32 with its lower holding portion 28 when the holding member 24 is brought into the projected position. As shown in FIG. 4G, the holder 11 is raised vertically while holding both the empty and full bobbins 31 and 32, until the full bobbin 32 held by the holder 11 is completely removed from the spindle 2. Thereafter, the holder 11 with the empty and full bobbins 31 and 32 is turned to the inclined position shown in FIG. 4H. In this case, and angle of the inclination of the holder 11 is preferably equal to that of the holder in the steps of FIGS. 4B to 4D and is designed such that the members 11, 31 and 32 do not interfere with any portion of the frame construction 1. In the step shown in FIG. 4I, the holder 11 moves down with the inclined position to apply only the full bobbin 32 to the peg 16. Then, the bobbin holder 11 causes the holding member 24 to release the empty and full bobbins 31 and 32 therefrom and raises in the inclined position along the empty bobbin 31 until it reaches the upper end of the empty bobbin 31 as shown in FIG. 4J. The holder 11 then grasps the upper end of the empty bobbin 31 and, as shown in FIG. 4K, raises while in inclined position to a position corresponding to that shown in FIG. 4D. In the next step shown in FIG. 4L, the bobbin holder 11 is turned to the upright condition, thus bringing the empty bobbin 31 in axial alignment with the spindle 2. The holder 11 moves straight down to apply the empty bobbin 31 to the spindle 2 as shown in FIG. 4M. After the completion of the fitting of the empty bobbin 31 onto the spindle 2, the holder 11 releases the empty bobbin 31 and moves up as shown in FIG. 4N and is turned in the inclined condition shown in FIG. 40 and moves down while in the inclined position to a position directly above the full bobbin 32 as shown in FIG. 4P and is turned to the upright rest position shown in FIG. 4Q corresponding to the position shown in FIG. 4A. Thus, the doffing and donning operation is completed.

After the doffing and donning operation, the conveyer is driven to transfer the full bobbins 32 on the pegs 16 to a predetermined position, in which the full bobbins are removed from the pegs and replaced with new empty bobbins.

While the invention has been illustrated and described with reference to a single preferred embodiment thereof, it is to be understood that various changes in the details of constructions and the arrangement and combination of parts may be made without departing from the spirit and scope of the invention.

What we claim is:

1. An apparatus for removing full bobbins from a succession of spindles of a spinning machine and applying empty bobbins to the spindles from which the full bobbins have been removed, the apparatus comprising bobbin conveying means extending along the side of the spinning machine and having a succession of bobbin supporting portions thereon corresponding in pitch to the spindles; a succession of bobbin holders arranged along the side of the spinning machine and corresponding in pitch to the spindles, each holder including means for defining a space for receiving the bobbin, and means movable relative to the space for restricting the size of the space to allow the holding of the bobbin, the restricting means of the holder including upper and lower contact surfaces movable relative to the space between an inoperative position, in which the space has a size larger than the diameter of the empty bobbin, and an operative position in which the space is restricted to a size sufficient to hold both the empty and full bobbins simultaneously owing to contacts of the upper and lower contact surfaces with the empty and full bobbins; and means for moving the holders to transfer the bobbins between the spindles and the conveying means.

2. An apparatus according to claim 1, wherein the space defining means comprises a generally hollow body with a through opening and the restricting means comprises a holding member movable radially in the hollow body to restrict the diameter of the through opening, the holding member having the upper and lower contact surfaces.

3. An apparatus according to claim 2, wherein the upper and lower contact surfaces of the holding member are arcuate surfaces.

4. In a method for removing full bobbins from a succession of spindles of a spinning machine and applying empty bobbins to the spindles from which the full bobbins have been removed, the spinning machine including a conveyor for conveying the empty and full bobbins along the side of the spinning machine and a succession of bobbin holders for holding and transferring the bobbins between the spindles and the conveyor, the steps of grasping an empty bobbin in each bobbin holder and moving said bobbin holders for moving the empty bobbins from the conveyor to an upright position above corresponding full bobbins and with each empty bobbin in axial alignment with the corresponding full bobbin, removing each full bobbin from the associated spindle by the corresponding bobbin holder while said bobbin holder is holding an empty bobbin, moving the bobbin holders with the empty and full bobbins therein to a position adjacent the conveyor, applying only the full bobbins to the conveyor while the bobbin holders are at said position, and thereafter moving the bobbin holders with only the empty bobbins therein back to the position above the now empty spindles and applying the empty bobbins to the spindles by moving the holders carrying the empty spindles downwardly.

5. The method as claimed in claim 4 in which, when the empty bobbins are positioned above the full bobbins in axial alignment therewith, said step of removing the full bobbins includes the step of releasing the empty bobbins from the bobbin holders for permitting them to fall until the lower ends of the empty bobbins abut the upper ends of the corresponding full bobbins.

6. The method as claimed in claim 5 in which said step of removing the full bobbins further includes, after the bobbins have been released, moving the holders downwardly along the empty bobbins to the junction between the abutting empty bobbins and full bobbins.

7. A bobbin doffing and donning method in a spinning machine including a succession of spindles, a conveyor for conveying the empty and full bobbins along the side of the spinning machine, and a succession of bobbin holders for holding and transferring the bobbins between the spindles and the conveyor, comprising the steps of:

removing each empty bobbin from the conveyor by grasping the upper end of an empty bobbin by a holder and moving the holder upwardly with the empty bobbin held at the upper end thereof;

moving the upwardly moved holder to position the empty bobbin above a corresponding full bobbin mounted on a spindle with the empty bobbin in axial alignment with the full bobbin;

releasing the empty bobbin from the holder to allow the lower end of the empty bobbin to abut against the upper end of the full bobbin;

moving the holder down along the empty bobbin until it reaches the junction where the empty and full bobbins abut and then grasping both the empty and full bobbins simultaneously;

removing the full bobbin from the spindle by moving the holder holding the empty and full bobbins up and then away from the spindle and then downwardly to adjacent the conveyor and placing only the full bobbin on the conveyor;

moving the holder upwardly along the empty bobbin and grasping the upper end of the empty bobbin with the holder; and moving the empty bobbin above the spindle and placing the empty bobbin on the spindle.

8. A bobbin holder having a single bobbin receiving opening extending therethrough for receiving bobbins, and a bobbin holding member movable radially relative to said opening between a projected position and a retracted position, said holding member having upper and lower holding portions spaced along said opening parallel to the axis thereof and capable of simultaneously holding two bobbins in axial alignment with each other when said bobbin holding member is moved into the opening in the projected position, said opening having an effective diameter larger than the maximum diameter of an empty bobbin when the bobbin holding member is moved into the retracted position.

* * * * *